US012061026B2

(12) United States Patent
Alessandrelli et al.

(10) Patent No.: US 12,061,026 B2
(45) Date of Patent: Aug. 13, 2024

(54) METHOD FOR MANAGING A HEAT PUMP OPERATING WITH A LOW ENVIRONMENTAL IMPACT OPERATING FLUID

(71) Applicant: ARISTON S.p.A., Fabriano (IT)

(72) Inventors: Roberto Alessandrelli, Milan (IT); Marco Molteni, Civate (IT)

( * ) Notice: Subject to any disclaimer, the term of this patent is extended or adjusted under 35 U.S.C. 154(b) by 0 days.

(21) Appl. No.: 17/692,906

(22) Filed: Mar. 11, 2022

(65) Prior Publication Data

US 2022/0307746 A1 Sep. 29, 2022

(51) Int. Cl.
*F25B 49/00* (2006.01)
*F25B 49/02* (2006.01)

(52) U.S. Cl.
CPC ..... *F25B 49/005* (2013.01); *F25B 49/02* (2013.01); *F25B 2500/16* (2013.01); *F25B 2500/19* (2013.01)

(58) Field of Classification Search
CPC .... F25B 49/005; F25B 49/02; F25B 2500/16; F25B 2500/19; F25B 31/002
See application file for complete search history.

(56) References Cited

U.S. PATENT DOCUMENTS 4,888,957 A * 12/1989 Chmielewski ..... F25B 41/34 62/84
2009/0113907 A1* 5/2009 Sakitani ..... F25B 9/06 62/197
2009/0260376 A1 10/2009 Kasahara et al.
2011/0113797 A1* 5/2011 Peyaud ..... F25B 49/02 62/84
2015/0330688 A1* 11/2015 Goel ..... F25B 49/022 62/115
2015/0330690 A1* 11/2015 Goel ..... F25B 7/00 62/175
2019/0085224 A1* 3/2019 Sethi ..... C09K 5/045
2019/0212038 A1* 7/2019 Senf, Jr. ..... B60P 3/20
2020/0200458 A1* 6/2020 Assouad ..... F25B 3/00

FOREIGN PATENT DOCUMENTS

EP 3745057 A1 12/2020
KR 20080008095 A 1/2008

OTHER PUBLICATIONS

Search Report for corresponding Italian Application No. 10202100007316, dated Dec. 15, 2021.

* cited by examiner

*Primary Examiner* — Henry T Crenshaw
(74) *Attorney, Agent, or Firm* — Egbert, McDaniel & Swartz, PLLC

(57) ABSTRACT

A method for managing and controlling a heat pump based on a compression/expansion thermodynamic cycle of an operating fluid including at least: first and second heat exchangers; an expansion valve; and a compressor. The compressor is able to suck and compress a wet operating fluid. A plurality of temperature sensors detects the delivery temperatures Tm of the compressor, an evaporation temperature SST in the first exchanger, and a condensation temperature SDT in the second exchanger. The temperature difference between the lubricating oil in the compressor and the operating fluid at the compressor delivery is kept equal to or greater than a safety threshold OIL_SH such that there is no condensation of the operating fluid in the lubricating oil.

7 Claims, 5 Drawing Sheets

METHOD FOR MANAGING A HEAT PUMP OPERATING WITH A LOW ENVIRONMENTAL IMPACT OPERATING FLUID

CROSS-REFERENCE TO RELATED APPLICATIONS

Not applicable.

BACKGROUND OF THE DISCLOSURE

Field of the Invention

The object of the invention is a heat pump, e.g. of an air conditioning apparatus in a residential and/or industrial environment, based on a compression/expansion thermodynamic cycle of an operating fluid with low environmental impact and capable of ensuring optimal operating conditions and maximum efficiency and performance.

More precisely, the invention relates to a management method or logic for said heat pump capable of ensuring optimal operating and performance conditions and preserving the functionality of its mechanical components, in particular of its compressor.

Even more precisely, the object of the invention is a management method or logic of a heat pump capable of optimizing the temperature of a low environmental impact operating fluid at the compressor discharge (hereinafter referred to as the "delivery temperature" of the compressor), so as to ensure the maximum reliability thereof (i.e., eliminating any risk of breakage and malfunction) and ensuring the same operating (or envelope) range of said conditioning apparatus with refrigerants having a higher GWP (Global Warming Potential).

In particular, the invention falls within the sector of heat pump conditioning apparatuses for residential and/or industrial environments (or similar areas), where "conditioning" is indifferently meant as "heating" or "cooling", preferably made by electrical energy.

Related Art

As is known, the conditioning of a building is obtained through the use of thermodynamic equipment and systems which include at least one thermodynamic machine configured to heat or cool a heat transfer fluid (e.g. water or air) intended to reach, through specific devices and/or distribution circuits, the various rooms of said building to release therein part of its heat energy or draw it from the same.

Known thermodynamic machines are, for example, the so-called heat pumps (hereinafter also abbreviated with the acronym HP) in which an operating fluid, which circulates in a refrigerant circuit, is evaporated at low temperature, brought to high pressure, condensed and finally brought back to the evaporation pressure.

Said heat pumps therefore comprise:

- at least a first heat exchanger in which the operating fluid absorbs, at constant pressure, heat energy from a first fluid F.f which is at a first temperature T.f,
- at least a second heat exchanger, in which the same operating fluid yields, at constant pressure, part of its heat energy to a second fluid F.c which is at a second temperature T.c>T.f,
- a compressor actuated by a motor and designed to compress said operating fluid between a minimum pressure thereof, that it has at the outlet of the first exchanger, to the maximum pressure that it has at the inlet of the second exchanger,
- a lamination valve that achieves an expansion, at substantially constant enthalpy, and a cooling of the operating fluid.

Said first heat transfer fluid F.f from which it draws heat is also called "cold well" while the second heat transfer fluid F.c to which heat is yielded is also known with the term of "hot well".

Heat pumps where the cold well consists of air and the hot well consists of water are called "air-water" (or vice versa "water-air") heat pumps.

The refrigerant circuit of the aforementioned heat pump, as known, may be switched between a "cooling" and a "heating" operating mode (and vice versa) with said first and second heat exchanger which may therefore operate, if necessary, either as a condenser or as an evaporator.

What has been said so far is visually shown in the p-h (pressure-enthalpy) diagram of FIG. 1 showing a typical A-B-C-D refrigerant expansion/compression refrigeration cycle of a refrigerant, e.g. of the well-known R410A gas, in which:

- section A-B represents the compression phase of the refrigerant coming from the evaporator, said refrigerant being generally discharged from the compressor in the form of overheated vapor with a pressure and a corresponding temperature, hereinafter respectively referred to as delivery pressure and temperature,
- section B-C represents the subsequent cooling and isobaric condensation phase of the refrigerant during which it dissipates its heat through a condenser passing from a overheated vapor state to a saturated or subcooled liquid state,
- section C-D represents the decompression of the same refrigerant through the lamination or expansion valve so as to have at the inlet of the evaporator a refrigerant in subcooled or saturated liquid or preferably biphasic liquid-vapor conditions (as in the example in FIG. 1—point D),
- section D-A represents the isobaric evaporation of the refrigerant in the evaporator up to a overheated degree greater than or equal to zero so as to have overheated (point A in FIG. 1) or saturated (point A' of FIG. 1) vapor respectively at the compressor suction.

Increasingly stringent regulations on said heat machines and related refrigerant circuits in environmental matters are progressively requiring the use of refrigerant fluids with low environmental impact (also known as reduced or low GWP—Global Warming Potential) refrigerants.

For example, since 2015 in Europe, a new regulation came into force known as the "F-GAS Certification", which requires to progressively reduce the use of those refrigerant gases that significantly contribute to the Earth's greenhouse effect and to the consequent global warming.

Such regulation provides that by 2030 the "equivalent $CO_2$" (a measure that expresses the impact on global warming of a certain amount of "greenhouse gas" compared to the same amount of carbon dioxide) currently attributable to greenhouse or polluting refrigerant gases is reduced by 80%.

Many companies and manufacturers of heat pumps or similar air conditioning devices are therefore replacing the "traditional" refrigerant gases having a high greenhouse effect (e.g. the aforementioned R410A) with less polluting operating fluids.

For example, the use of a refrigerant gas with reduced GWP, known as R32, belonging to the group of hydrofluorocarbons and consisting of a difluoromethane (chemical formula: $CH_2F_2$) has been found very advantageous. Such refrigerant (or other similar ones belonging to the same family or similar groups), although with a low environmental impact, is not free from problems.

In particular, as shown in FIG. 4*a*, assuming a suction thereof to the compressor in a state of saturated or overheated vapor, R32 (or similar/equivalent refrigerants) has the disadvantage, compared to the refrigerants (R410A) most commonly used so far with which, in the graph in the figure, is compared, of significantly increasing the delivery temperature of the heat pump compressor (obviously with the same other operating conditions being equal such as, for example, the condensation and evaporation temperatures).

There is therefore the risk that the compressor delivery temperatures deriving from the compression of a low environmental impact refrigerant may approach and sometimes exceed the maximum limit set by the compressor operator with negative effects both on the various mechanical components of the compressor and on the chemical-physical features of the lubricating oil present therein for the lubrication of the moving parts.

In fact, it is known that too high delivery temperatures may correspond to undesirable overheating of the electric motor of the compressor, and to an impairment of the lubricating properties of the oil with inevitable risks of breakdowns and malfunctions.

To maintain the delivery temperature substantially equal to that of traditional refrigerants and avoid the aforementioned problems, it is known to limit the minimum evaporation temperature at equal condensing temperature (in this regard, see FIG. 4*c*) or, vice versa, to limit the maximum condensing temperature at equal evaporation (FIG. 4*b*) or, finally, to implement a combination between the two limitations of the evaporation and condensation temperature; in all these cases, however, there is therefore a significant reduction in the operating range of the heat pump compared to that ensured by the traditional refrigerants used so far, such as R410A.

Over the last few years, some solutions have therefore been studied in order to "optimise" the delivery temperature of low environmental impact refrigerants, without deteriorating the efficiency of the compressor and/or the performance of the refrigeration cycle.

For example, in the field of the cooling/heating machines and apparatus, the so-called "EVI" (Enhanced Vapor Injection) technology has been developed consisting of the injection of vapor in an intermediate stage of the compression process so as to ensure the achievement of a double benefit:

- an increase in the heating capacity at the same compressor displacement, and
- a desired reduction in the compressor delivery temperature.

Such technology provides that some liquid refrigerant, extracted from the high pressure side of the refrigeration cycle, is by-passed towards the compressor by means of a conduit whereon at least one expansion valve and a heat exchanger, generally a plate heat exchanger, that works as a sub-cooler or economizer, are inserted.

Along such bypass, the liquid refrigerant switches to the form of overheated vapor to be injected into the compressor substantially in the middle of the compression process thereof (cycle not shown in the accompanying figures).

This involves a reduction in the enthalpy of the refrigerant in the compression phase and therefore the compressor delivery temperature.

It is however evident that this EVI technology, although efficient, leads to greater constructive complexity of the heat pump and therefore higher production and marketing costs of the same and set up and management difficulties.

Alternatively, it is also known from the scientific literature how the optimization (in particular a reduction thereof) of the compressor delivery temperature may be obtained through the suction to the compressor, and the consequent compression, of a refrigerant in a liquid-vapor biphasic state. (point A" of FIG. 2 or 3).

More precisely, it has been observed how the compressor delivery temperature decreases as the humid fraction of the refrigerant entering the compressor increases and how this may be managed by regulating the opening degree of the expansion valve of the refrigeration cycle.

However, also the regulation of said expansion valve has not proved to be free from problems.

More precisely, there is a risk that the compressor delivery temperature is excessively reduced, e.g. up to below the condensation temperature of the refrigerant, with the consequent condensation thereof in the oil inside the compressor.

It is known how a condensation of the refrigerant in the compressor oil leads to dilution and the impairment of the lubricating properties thereof.

This is strongly felt in rotary compressors, such as for example those of the "High Side" type, where the oil plays a primary function in ensuring the correct lubrication of the moving parts.

As schematically shown by way of example in FIG. 6, this type of compressors, widely used in heat pumps, is in fact characterised by one or more compression chambers C2 of the refrigerant, (in the example in figure two chambers), set in rotation, in phase opposition, by an electric motor C4 and completely immersed in the lubricating oil contained in the lower part of the compressor body C11, also known as oil sump C3.

Once compressed, the refrigerant discharged from one or more compression chambers C2 at the delivery temperature is therefore forced to lap and/or cross the lubricating oil before rising up the entire body C1 of the compressor C, cool the electric motor C4 and reach the outlet pipe C5 connected to a heat exchanger placed downstream (the condenser of the refrigeration cycle). It is therefore clear that due to this direct interaction, the risk of oil dilution by the refrigerant is particularly high and harmful.

BRIEF SUMMARY OF THE INVENTION

The purpose of the present invention is to provide an innovative control and management logic for a heat pump, for example of a conditioning apparatus in a residential and/or industrial environment, based on a compression/expansion thermodynamic cycle of an operating fluid at low environmental impact (GWP) which obviates such kind of drawbacks.

More precisely, the object of the present invention is to provide, according to one or more variants, a management logic of said heat pump capable of ensuring optimal operating and performance conditions and of preserving the functionality and duration of its mechanical components, in detail of its compressor.

Even more precisely, the object of the present invention, at least in a preferred variant thereof, is to indicate a management method for a heat pump capable of optimising the temperature of a low environmental impact (GWP) operating fluid to the compressor discharge, without compromising the operating range (or envelope) of said heat pump and the reliability of the same compressor.

These and other objects, which shall become clear later, are achieved with a conditioning apparatus' heat pump management method/logic for a residential and/or industrial environment, based on a thermodynamic compression/expansion cycle of a low environmental impact (GWP) operating fluid, in accordance with the provisions of the independent claims.

Other objects may also be achieved by means of the additional features of the dependent claims.

BRIEF DESCRIPTION OF THE SEVERAL VIEWS OF THE DRAWINGS

Further features of the present invention shall be better highlighted by the following description of a preferred embodiment, in accordance with the patent claims and illustrated, purely by way of a non-limiting example, in the annexed drawing tables, wherein:

DETAILED DESCRIPTION OF THE INVENTION

The features of a preferred variant of the apparatus are now described for the conditioning of a residential and/or industrial environment and the related management logic according to the invention are now described, using the references contained in the figures.

It is noted that any dimensional and spatial term (such as "lower", "upper", "inner", "outer", "upstream", "downstream" and the like) refers to the positions of the elements as shown in the annexed figures, without any limiting intent relative to the possible operating conditions In the present description, by conditioning apparatus is intended a thermodynamic machine set up for the heating and/or cooling of a residential, industrial or similar environment.

Without any limiting intent, reference shall be made to heat pumps, preferably of the air-water type, although everything that will be said with reference thereto may be extended to any other type of heat pumps, e.g. of the water-water or air-air type, or similar/equivalent heat machines.

Figure 5:
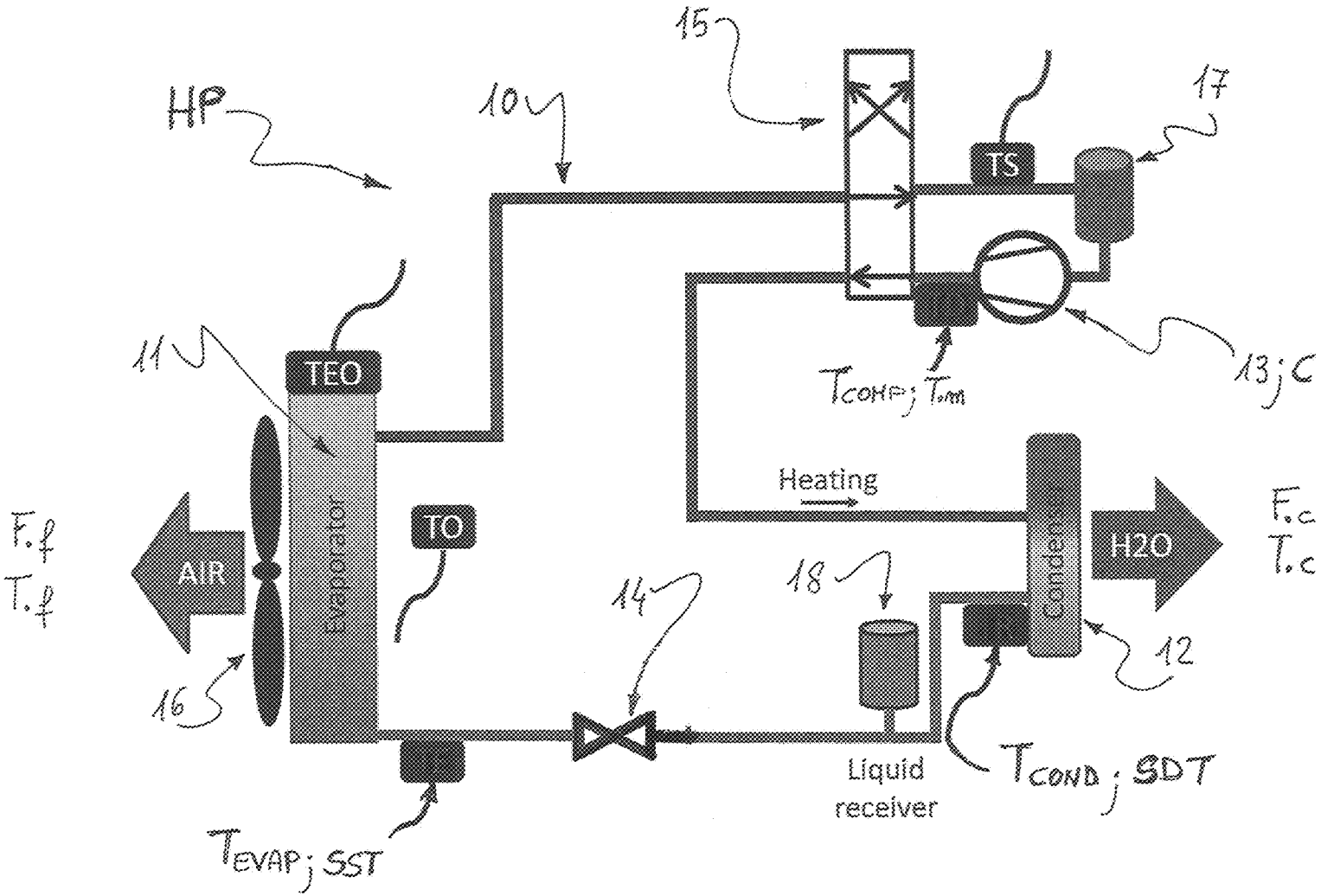
FIG. 5 schematically and symbolically represents a heat pump of a typical conditioning apparatus (in heating mode) capable of implementing the refrigeration cycle of the previous figures.

FIG. 5 therefore shows the diagram of a heat pump HP, preferably reversible for ambient cooling and/or heating (but for simplicity herein shown in heating mode), wherein an expansion/compression refrigeration cycle of an operating fluid, hereinafter simply referred to as "refrigerant", is made.

As already mentioned, said pump HP comprises, connected to each other by means of suitable pipes 10, at least:

- a first heat exchanger 11, 12 wherein the refrigerant absorbs, at constant pressure, heat energy from a first fluid F.f, which is at a first temperature T.f and which defines the so-called "cold well",
- a second heat exchanger 12, 11 wherein the same refrigerant yields, at constant pressure, part of its heat energy to a second fluid F.c, which is at a second temperature T.c >T.f and that corresponds to the so-called "hot well",
- a compressor 13 compatible to receive at suction and compress a refrigerant fluid comprising a certain percentage of wet fraction (i.e., at least in part in the liquid state), preferably of the "High Side" type, driven by an electric motor and adapted to compress said refrigerant between its minimum pressure, that it has at the outlet of the first exchanger 11, 12, and its maximum pressure, that it has at the inlet of the second exchanger 12, 11,
- an expansion valve 14, placed between said first 11, 12 and second 12, 11 heat exchanger, which makes a constant enthalpy expansion and a cooling of the refrigerant.

Reference 15 also denotes a switch valve, e.g. a "four-ways valve", which enables to convert the operation of a heat pump HP between a "cooling" mode and a heating mode (or vice versa).

When in heating mode, the refrigerant dissipates heat in the second exchanger, which therefore acts as a condenser 12, while evaporates in the first evaporator that acts as an evaporator 11.

On the contrary, in cooling mode, the aforementioned first heat exchanger is the condenser 11 of the refrigerant circuit, the second exchanger is the relative evaporator 12.

More precisely, therefore, the exchanger 12 is the one where the heat transfer fluid intended for a user is heated or cooled, while the exchanger 11 is the one cooperating with the well where the heat yielded or subtracted from said user is absorbed or disposed of.

For descriptive simplicity, hereinafter, explicit reference will be made to a heat pump HP in "heating" mode (to which, as already said, FIG. 5 refers to without any limiting intent), although all that will be said with reference to such operating mode, may be also extended to "cooling", the aforementioned inversion of the refrigeration cycle operated by the switch valve 15 being known. Furthermore, in the example of FIG. 5, reference shall be made to an air-water heat pump HP whose cold well F.f is the environment air wherein it is installed while the relative hot well F.c is preferably the water circulating in a specific distribution circuit for the room heating.

Of course, nothing prevents said hot well from consisting of water contained inside a storage and intended for hygienic-sanitary uses.

The refrigerant circuit is then completed by at least one fan 16 moving the air F.f through the evaporator 11 while the compressor 13 may be equipped with an accumulator 17 placed upstream its suction section and adapted to prevent, as is known, excesses of refrigerant, oil or impurities therein.

A second known refrigerant accumulator 18 (called "liquid receiver") may be provided at the expansion valve 14 in order to compensate for any differences or variations in the levels and quantities of said refrigerant between the condenser and the evaporator.

For the purposes of the invention, a plurality of temperature sensors is also present along the refrigeration circuit.

In particular, it is envisaged:

- at least one temperature sensor T.com at the outlet of the same compressor 13 for the detection of its delivery temperature Tm,
- at least one temperature sensor T.evap at the evaporator 11 for the detection of an evaporation temperature "SST",
- at least one temperature sensor T.cond at the condenser 12 for the detection of a condensation temperature "SDT".

Preferably, further temperature sensors T.f.c and T.f.f may also be provided for the measurement of the temperatures of hot well and cold well T.a, T.w.

It is clear how said temperature sensors, at least those placed at the evaporator 11 and condenser 12, may be replaced by corresponding pressure sensors, given the known correlation between pressures and temperatures of a refrigerant fluid in phase change.

It is equally known how changes in the environmental conditions in which the heat pump HP operates, eg. of the temperatures T.c, T.f, of the relative hot and cold wells, affect the high and low pressure and/or temperature values of the refrigeration cycle and therefore lead to changes in the operating conditions of said heat pump HP.

According to the invention, the heat pump HP is configured and managed in such a way as to control the wet fraction (or percentage) of the refrigerant at the inlet of the compressor 13 by adjusting the evaporative power of the evaporator 11 and in such a way that the temperature difference between the lubricating oil of the compressor 13 and the operating fluid (refrigerant) at the delivery of the same compressor 13, is kept at least equal to or above a safety (or threshold) value such that there is no condensation of said operating fluid in said lubricant oil, thus avoiding dilution and the loss of the optimal chemical-physical properties.

In other words, the temperature Toil of the lubricating oil should be always higher than the temperature Tm of the operating fluid at the compressor delivery 13 by at least one appropriate margin defined by a safety threshold OIL_SH; i.e. the following relationship is wished to be verified:

$$Toil - Tm \geq OIL_SH \quad (1)$$

where said safety threshold OIL_SH (that shall be referred to in the present description) is:

- that avoiding condensation of the refrigerant in the lubricating oil that is too cold due to any heat losses of the compressor and/or the too low temperature of the same operating fluid, said factors leading to an excessive cooling of said oil,
- suggested or set by the compressor manufacturer company or by the compressor operator,
- it is preferably a value comprised between 5° C. and 10° C., for example advantageously equal to 7° C. (such value hereinafter being also referred to as OIL_SH_opt).

As it shall be seen more precisely below, what has just been said above (i.e., the satisfaction of the relationship (1)) is obtained by suitably controlling and regulating the delivery temperature Tm of the compressor 13 by acting on the aforementioned expansion valve 14.

This does not mean that in certain cases it is possible, alternatively or in combination, to directly heat said lubricating oil of the compressor 13.

According to a first preferred variant of the invention, therefore, the humid fraction of the refrigerant at the compressor suction 13 is increased or decreased by regulating the opening degree of the expansion valve 14, placed upstream of the evaporator 11.

In fact, it is known that an increase in the opening degree of the expansion valve 14 corresponds to, at the evaporator inlet 11, an increase in the evaporation pressure and a greater quantity of liquid refrigerant in the liquid state; this increases the amount of refrigerant that may not be evaporated by the evaporator 11 and therefore the wet fraction of the same entering the compressor 13.

On the contrary, a greater closure of the expansion valve 14 will result in a reduction in the evaporation pressure at the inlet of the evaporator 11, a lower amount of liquid refrigerant to evaporate and therefore a lower wet fraction at the inlet of the compressor 13.

It is also known that the value of its delivery temperature Tm depends directly on the percentage of the wet fraction at the inlet of the compressor 13.

Figure 1:
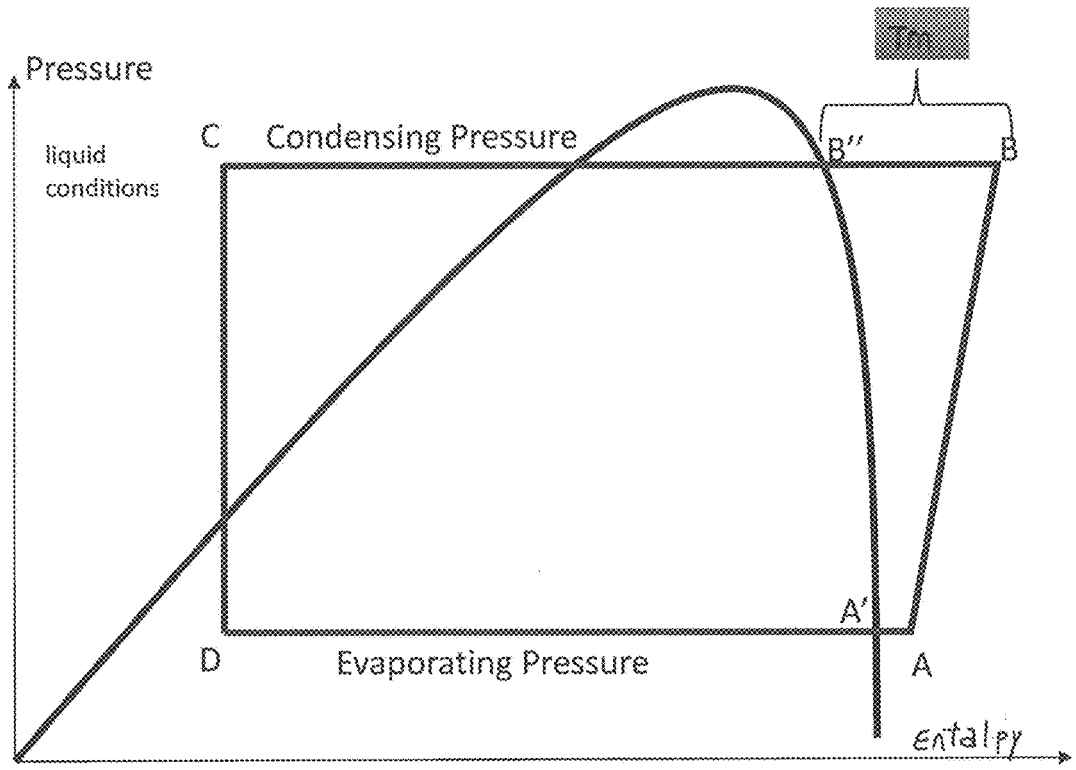
FIG. 1 shows on a diagram P-h a known compression/expansion refrigeration cycle of an operating fluid.
Figure 2:
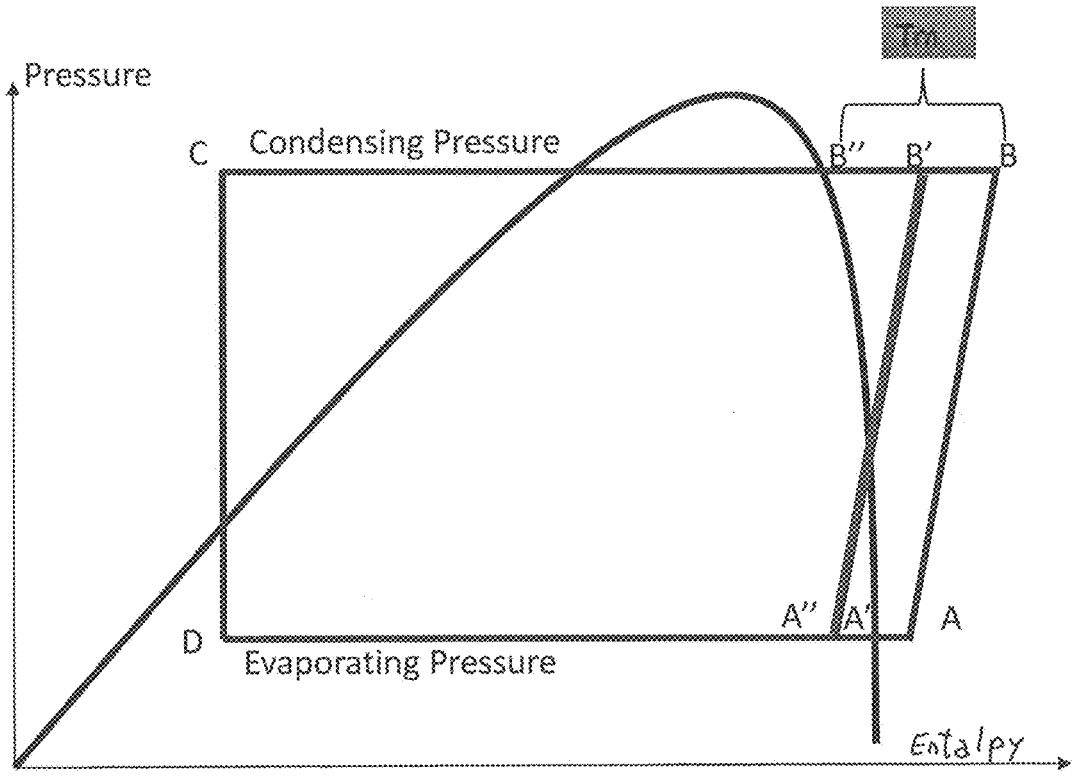
FIG. 2 shows on a diagram P-h a known compression/expansion refrigeration cycle of an operating fluid compared with the refrigeration cycle according to the invention.
Figure 3:
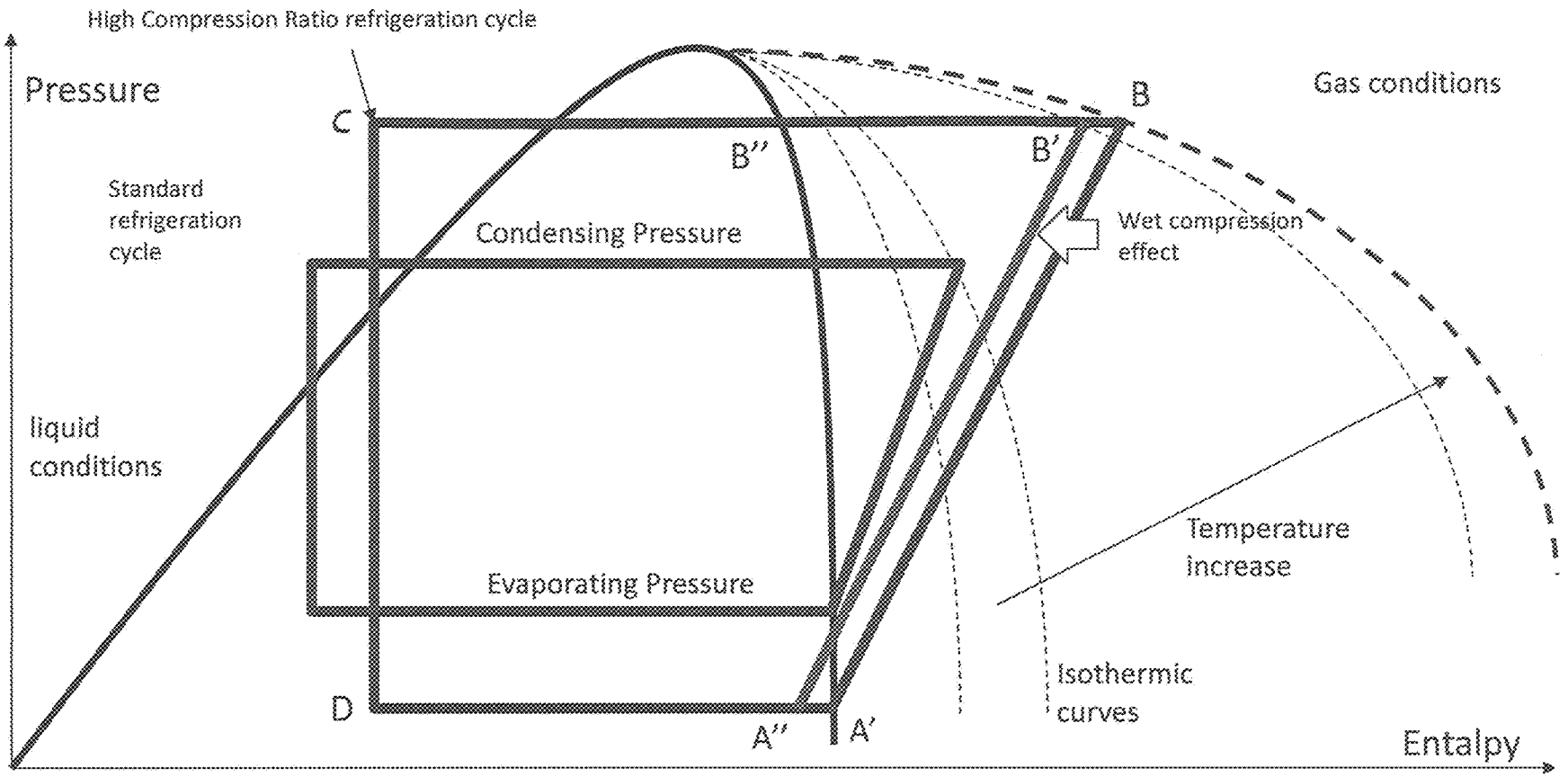
FIG. 3 shows on a diagram P-h in more detail, the refrigeration cycles of FIGS. 1 and 2 compared with a further standard refrigeration cycle for the same operating fluid.
Figure 4:
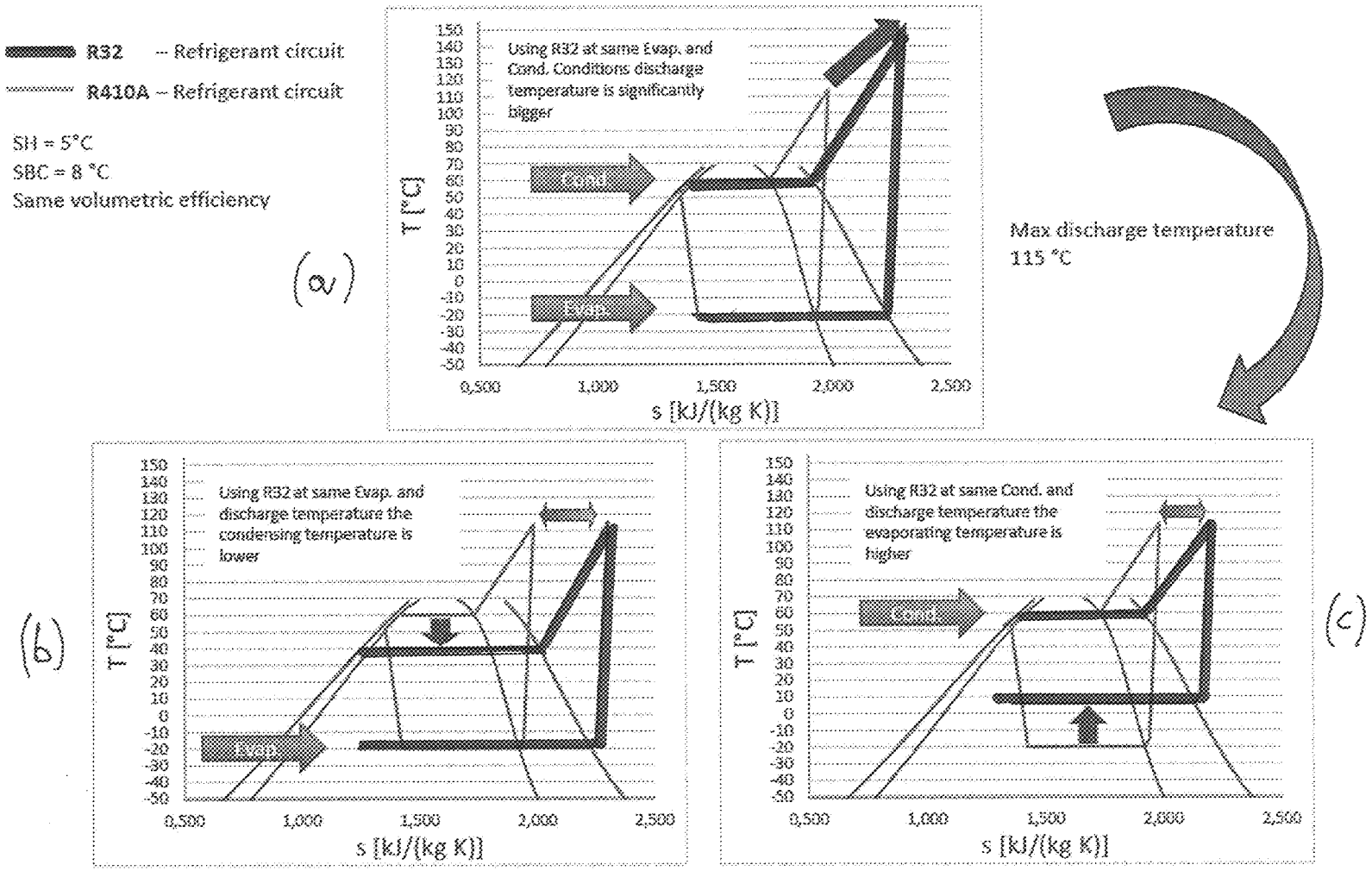
FIGS. 4*a*-4*c* show on a diagram T-s a comparison between a compression/expansion refrigeration cycle of a traditional operating fluid (e.g. R410A) and a similar compression/expansion refrigeration cycle of an operating fluid with low environmental impact (GWP)
Figure 6:
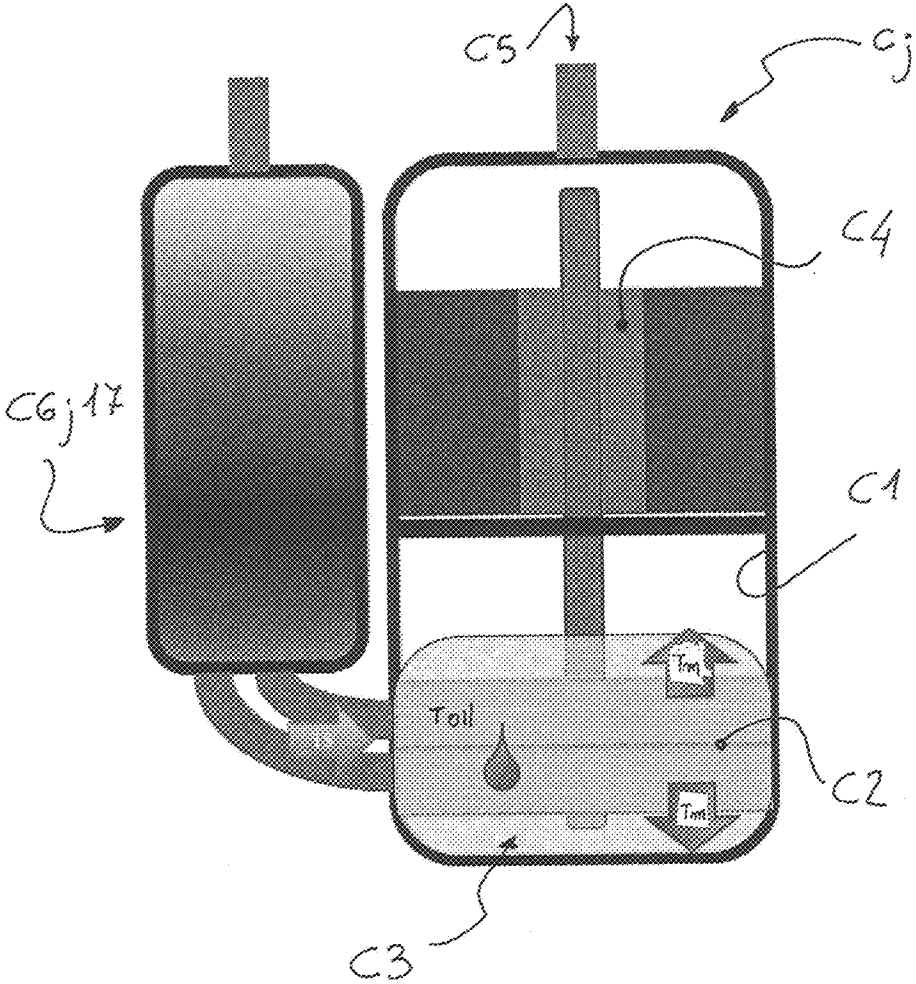
FIG. 6 schematically shows a "simplified" view of a "High Side" compressor of the heat pump of FIG. 5.

For clarity of description, it is obvious that said "delivery temperature", generically referred to with the reference Tm, is the temperature "read/measured" at point B, B' . . . $B^i$ of the refrigeration cycle (see FIGS. 1-3 attached to the description), that is at the outlet of one or more compression chambers of the compressor 13 (see, for example, FIG. 6).

In particular, it is known that said delivery temperature Tm decreases as the percentage of wet fraction of the refrigerant sucked by the compressor 13 increases. This is clearly shown in FIG. 2 or 3 where points B and B' define the delivery temperatures (with Tm_B>Tm_B') following the compression, respectively, of a refrigerant in the saturated vapor state (point A') and of a wet refrigerant (point A").

According to the invention, the delivery temperature Tm of the compressor 13 is therefore regulated and determined by regulating the wet fraction of the refrigerant to be compressed.

More precisely, the heat pump HP of the invention is configured to control the percentage of wet fraction of the refrigerant entering the compressor 13 in such a way as to make the aforementioned delivery temperature Tm equal to an "optimal" delivery temperature, hereinafter referred to as "target delivery temperature or Tm_target".

Said delivery temperature Tm_target, which, as shall be seen, is determined for every operating condition of the heat pump HP, is that temperature which, even when using a low environmental impact refrigerant (e.g. the aforementioned R32), ensures:

- the optimal wet fraction for the refrigerant entering the compressor 13 (i.e. such as to operate in a suitable wet compression condition),
- optimum performance of the machine, said temperature compensating for the reduction of the operating (or envelope) range of the machine resulting from the use of said low environmental impact refrigerant (e.g. the R32), and/or
- a delivery temperature Tm of the compressor 13:
  - neither too high to abnormally overheat the lubricating oil inside the compressor 13 and/or the relative motor, exposing it to breakages or temporary interruptions in the operation thereof,
  - nor too low to get excessively close to the temperature of the lubricating oil, i.e. to values that may cause the condensation of the refrigerant in the same oil and therefore the dilution thereof (also with the inevitable impairment of its ability to lubricate the moving parts of the compressor 13 and/or of other chemical-physical features thereof).

For such purpose, the expansion valve 14 of the heat pump HP is preferably an electromechanical valve and its opening degree is suitably piloted and regulated, for example by means of a feedback control system, as long as the compressor delivery temperature Tm 13 does not approximate and/or reach the aforementioned target delivery temperature Tm_target.

Preferably, said control of the expansion valve 14 is, without any limiting intent, a control of the Proportional-Integral-Derivative type (hereinafter also briefly called "PID control").

In other words, it has been observed that an "optimal" percentage of the wet fraction of the refrigerant at the compressor suction 13 corresponds to a delivery temperature Tm equal to a target delivery temperature Tm_target the value thereof is substantially determined as a function "ƒ1" of at least:

- a first pair of parameters, variable, which depend on:
  - the environmental conditions in which the heat pump HP operates, e.g. from the temperatures T.c, T.f of the relative hot and cold wells, and/or
  - the operating conditions of the same heat pump, e.g. the opening degree of its expansion valve 14,
- a second pair of parameters, preferably constant, representative of the type and technical features of the compressor 13 of said heat pump HP.

More precisely, said first pair of parameters preferably comprises:

- the evaporation temperature SST detected by the aforementioned temperature sensor T.evap placed at the evaporator 11, and
- the condensation temperature SDT detected by the aforementioned temperature sensor T.cond placed at the condenser 12, while said second pair of parameters may comprise:

- the aforementioned safety (or threshold) value OIL_SH for the difference between the temperature of the lubricating oil inside the compressor 13 and that of the refrigerant in the refrigeration circuit (at the delivery of the same compressor),
- a correction coefficient k, also a function of the technical features of the compressor 13, in particular of its heat insulation, and adapted to take into account the inevitable heat losses between the compressor 13 and the environment (air) in which the heat pump HP operates, i.e., the heat exchange between the lubricating oil and the compressor 13 and between the lubricating oil and the refrigerant.

In formula:

$$Tm_\text{target}=f1(SDT,SST,k,\text{OIL}_SH) \quad (2)$$

Preferably, Tm_target may be equal to the sum between the aforementioned condensation temperature SDT, the OIL_SH value and a correction "ƒ2" which, in turn, is determined according to the model and technical features of the compressor 13 and the operating conditions of the heat pump. HP, i.e. its condensation and evaporation temperatures SDT, SST and the safety (or threshold) value OIL_SH; in formula:

$$Tm_\text{target}=SDT+\text{OIL}_SH+f2(SDT,SST,k,\text{OIL}_SH) \quad (3)$$

Even more specifically, said correction ƒ2 is preferably equal to the algebraic sum "SDT+OIL_SH−SST" between the condensation and evaporation temperatures of the heat pump HP and the safety (or threshold) value for the acceptable temperature difference between compressor lubricant oil and delivery refrigerant, which is given a "weight" k that depends on the model of the compressor 13 and its technical features (i.e., corresponding to the aforementioned correction coefficient k which takes into account the heat losses to the compressor); in formula:

$$Tm_\text{target}=SDT+\text{OIL}_SH+k*(SDT+\text{OIL_SH}-SST) \quad (4)$$

It is useful to reiterate how the correction ƒ2=k*(SDT+OIL_SH−SST) substantially represents a contribution that takes into account the heat losses between the compressor 13 of the heat pump HP and the environment (air) in which it operates and which may be due to an excessive cooling of the lubricating oil in the same compressor 13.

In particular, said correction ƒ2 takes into account the heat exchange coefficients:

- α1 between lubricating oil and refrigerant of the refrigeration circuit of the heat pump (HP), and
- α2 between the same lubricating oil and the operating environment of said heat pump HP.

This is easily inferable from the following syllogism.

In the presence of heat losses between compressor 13 and environment (air), the heat balance is to be checked:

$$(Tm_\text{target}_T\text{oil})*\alpha 1=(T\text{oil}-T\text{air})*\alpha 2 \quad (5)$$

hence, assuming:

- a Toil=SDT+OIL_SH that represents the oil temperature in the ideal case of total absence of heat losses,
- a Tair=SST (in order to take into account the worst operating conditions for a heat pump HP; Tair is in fact>of the evaporation temperature), $$(Tm_\text{target}-SDT-\text{OIL}_SH)*\alpha 1=(SDT+\text{OIL}_SH-SST)*\alpha 2 \quad (6)$$

is obtained from which:

$$Tm_\text{target}=SDT+\text{OIL}_SH+\alpha 2/\alpha 1*(SDT+\text{OIL}_SH-SST) \quad (6')$$

and wherefrom it may be further seen, how the ratio:

α2/α1 effectively corresponds to the correction coefficient k previously introduced and described.

In other words, it has been shown that the correction coefficient k=α2/α1 introduced in order to take into account the possible cooling of the lubricating oil of the compressor 13 due to the heat losses towards the outside is defined as the ratio of the heat exchange coefficients between lubricating oil and refrigerant and between the lubricating oil and the operating environment of the heat pump HP.

By way of a non-limiting example, the corrective coefficient k may be comprised between 0.05<k<0.35, with lower values the more effectively the compressor 13 of said heat pump HP is thermally insulated.

Laboratory tests have shown that k may be preferably equal to 0.15, possibly increasable, for safety reasons, to 0.25.

As already anticipated, according to the invention, the expansion valve 14 of the HP heat pump is piloted, preferably by means of a PID control, to regulate its opening degree so as to ensure a refrigerant temperature Tm equal to the Tm_target, as defined above, to the compressor delivery It is noted that said formula of the $$Tm_\text{target}=SDT+\text{OIL}_SH+k*(SDT+\text{OIL}_SH-SST) \quad (7)$$

is recursive: in fact, at every regulation of the expansion valve 14, in addition to a change in the delivery temperature Tm actually measured at the outlet of the compressor 13, also new values of the condensation SDT and evaporation SST temperatures correspond and therefore of the same Tm_target calculated by the formula.

Therefore, it seems more correct to define said Tm_target with the following formula:

$$Tm_target = Tm.t = SDT.t + OIL_SH + k*(SDT.t + OIL_SH - SST.t) \quad (8)$$

where:

SDT.t represents the condensation temperature at an instant t and dependent on the actual value of the delivery temperature TD.t of the compressor 13 at the same instant t;

SST.t represents the evaporation temperature at an instant t and depends on the actual value of the delivery temperature TD.t of the compressor 13 at the same instant t, Tm_target.t is equal to the compressor 13 delivery Tm.t considered ideal and optimal for the SDT.t and SST.t values just read and measured at said instant t, OIL_SH is, as seen, a threshold value, specific of the compressor 13 and representative of a temperature difference between the lubricating oil and the refrigerant and for which there is no condensation of the refrigerant in the lubricating oil (a value preferably comprised between 5° C. and 10° C., for example equal to OIL_SH_opt=7° C.), k is the aforementioned correction coefficient which takes into account the heat losses at the compressor 13.

Therefore, according to the logic of the invention, during the control and regulation of the opening degree of the expansion valve 14 of the heat pump HP, in different and consecutive time instants $t_1, t_2, \ldots, t_{n-1}, t_n, t_{n+1}$, condensation and evaporation temperature values are measured, which in turn depend on the value of the delivery temperature Tm.tn of the compressor 13 existing at the moment tn of said measurement; i.e., at the instant tn there will be a:

condensation temperature SDT.tn=SDT(Tm.tn), and an evaporation temperature SST.tn=SST(Tm.tn).

From such values and known the constants OIL_SH, OIL_SH_opt and k, the value of the target delivery temperature of the compressor Tm_target, that is to be reached at the next instant tn+1 by operating the expansion valve 14, is obtained and calculated.

This means that in an instant tn+1 subsequent to tn, by further regulating the opening degree of the expansion valve 14, a delivery temperature Tm_target.tn+1 is aimed at, the value thereof depends on that of the evaporation SST.tn, condensing SDT.tn, and delivery temperature Tm.tn of the compressor 13 read at said instant tn.

The expansion valve 14 is therefore manoeuvred, more or less "abruptly" by the PID control (through its proportional, derivative and/or integrative criteria), according to the difference between the last value of the delivery temperature Tm.tn read and measured at an instant tn and the last corresponding value calculated for the target delivery temperature Tm_target.tn+1, i.e., in formula:

$$Tm_target.t_{n+1} = SDT.tn + OIL_SH + k*(SDT.tn + OIL_SH - SST.tn) \quad (10)$$

If the heat pump HP is operating in steady state, in particular if the temperatures T.f, T.c of the cold and hot well remain substantially constant, for example because there is a continuous water consumption that subtracts heat power from the hot well (e.g. from one of its tanks) a heat power substantially equal to that introduced by the heat pump HP, it is obtained that at a certain instant tn+1:

$Tm_target.t_{n+1} = Tm_target.t_n$ already reached at instant tn, and the expansion valve no longer has to correct its opening degree.

In other words, in steady state, the subsequent values of the Tm_target provided by the logic of the invention calculated on the basis of the condensation SDT and evaporation SST temperature values read at the instant immediately preceding converge to a constant and invariant value Tm_target over time.

In this way, even in conditions of compression of a wet operating or refrigerant fluid (wet compression), it is therefore possible to ensure that the actual delivery temperature Tm of the compressor 13:

always remains below a maximum allowable limit defined by the manufacturer in order to avoid breakages and malfunctions due to an excessive overheating of the lubricating oil and/or of the parts and mechanical and electronic components thereof, but it is not too low to get too close to the temperature of the lubricating oil of said compressor, i.e. to values that may cause the condensation of the refrigerant in said oil causing it to dilute (i.e., which is equivalent, so that said oil remains hot enough).

Figure 7:
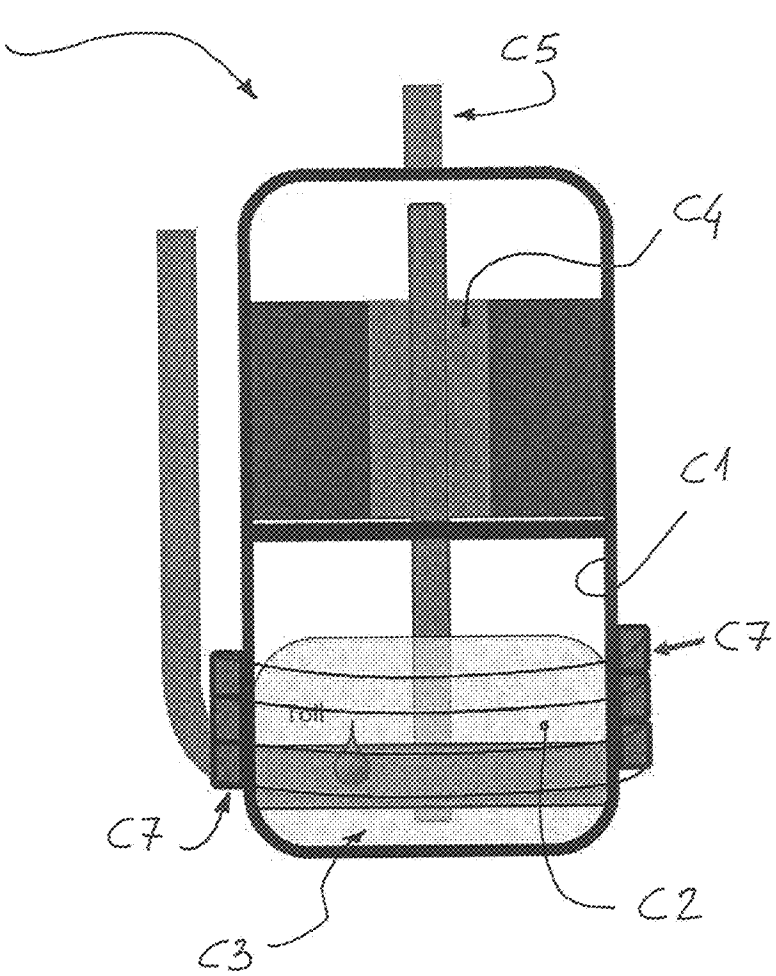
FIG. 7 schematically shows a "simplified" view of a "High Side" compressor of the heat pump of FIG. 5 according to a possible variant of the invention.

According to a variant of the invention, and in certain operating phases of the heat pump HP, it is possible, alternatively or in combination with the regulation of the opening degree of the expansion valve 14 described above, to keep the lubricating oil of the compressor 13 hot enough, and consequently prevent the refrigerant from condensing therein, directly heating said oil; for such purpose, a heating element C7, preferably an electric resistance C7, placed externally to the oil sump C3 of the compressor 13 (see FIG. 7) may therefore be provided. According to such variant, during the compression of the wet refrigerant, it is desired to maintain the temperature difference between the lubricating oil and the refrigerant at the delivery of the compressor 13 above a certain minimum safety threshold OIL_SH_min, representative of a sufficiently high temperature of the lubricating oil to avoid the condensation of the refrigerant. In particular, from the formulas previously defined and described (in particular from the formula (8)), it is possible to define such difference as:

$$OIL_SH = [Tm - SDT*(1+k) + k*SST]/(1+k) \quad (11)$$

and the electric resistance C7 will be activated if said calculated value of OIL_SH is lower than the aforementioned OIL_SH_min, obviously taking into account a suitable hysteresis; in formula:

if OIL_SH<(OIL_SH_min)→the resistance is activated;

if OIL_SH>(OIL_SH_min+hysteresis)→the electric resistance remains switched off or, if already in operation, it is deactivated.

Preferably, said minimum threshold value OIL_SH_min, indicative for the activation or not of the electric resistance C7, is a value lower than the safety threshold OIL_SH_opt to be ensured and maintained during the regulation of the opening degree of the previously described expansion valve 14.

By way of an example, since OIL_SH_opt was preferably assumed to be equal to 7° C., the minimum threshold value OIL_SH_min for the switching on/off of said electric resistance C7 may be set substantially equal to 5° C.

In such case, for the purposes of the invention, the control and regulation of the expansion valve 14 may be associated in a synergic and combined way with the control on the activation of the electric resistance C7 of the compressor 13.

In fact, one would operate with the sole regulation of the expansion valve 14, in the ways seen above, as long as the temperature difference between the lubricating oil inside the compressor 13 and the wet refrigerant compressed therein remains substantially around the set and desired value OIL_SH_opt (i.e., at which there is no condensation of refrigerant in the oil) while the electric resistance C7 would activate if said oil-refrigerant temperature difference would drop below the aforementioned minimum threshold OIL_SH_min (as said, e.g., equal to 5° C.), as it may happen in some transient conditions of the compressor 13 (in such cases, i.e., the regulation of the expansion valve 14 alone may be too slow to avoid said undesired condensation of the refrigerant in the oil).

For example, during the starts of the compressor 13 with low external ambient temperatures, i.e. when the lubricating oil temperatures therein may be very low, the electric resistance C7 is first switched on to quickly heat the oil and report the difference between its temperature and that of the refrigerant at values higher than OIL_SH_min, therefore, once deactivated, the aforementioned regulation of the expansion valve 14 is proceeded.

Of course, nothing prevents the possibility of controlling and measuring the temperature difference between the lubricating oil and the refrigerant, in the ways discussed above, even during and substantially concurrently with the regulation phases of the expansion valve 14.

From the formula (11) just above, it is in fact clear how said difference OIL_SH between oil and refrigerant may be determined as a function of the delivery Tm, condensation SDT and evaporation temperatures SST of the heat pump HP which, as seen, vary at every regulation of the opening degree of the expansion valve 14, and by the aforementioned correction coefficient k for the heat losses to the compressor 13.

Therefore, it is possible to control and pilot the activation or not of the electric resistance C7 (once the conditions indicated above are met) substantially after every regulation of the opening degree of the expansion valve 14 or after a predetermined number of consecutive regulations of the same.

More precisely, if, following the regulation of said expansion valve 14 to the consequent delivery, expansion and condensation temperature values read, of the heat pump HP, and/or in case of changed environmental or operating environmental conditions, a value of OIL_SH_min corresponds to the minimum allowable one OIL_SH the electric resistance C7 would activate to quickly heat the oil and bring OIL_SH back to safety values, avoiding every risk of condensation of the refrigerant in the lubricating oil.

Finally, nothing prevents an extremely simplified form of control in which the ignition or not of the electric resistance C7 is delegated to a direct detection of the lubricating oil temperature, rather than as a function of the aforementioned delivery, evaporation and condensation temperatures of the heat pump HP.

In such case, at least one temperature sensor may be provided for the detection of said compressor 13 oil temperature Toil, adapted to the lubrication of at least its moving parts (for example, as seen, for at least one or more compression chambers C2), said sensor being able to be placed, for example, in contact with sump C3 of said compressor 13.

It is clear that several variants of the method of the invention for the control and management of the delivery temperature of a compressor of a heat pump are possible to the man skilled in the art, without departing from the novelty scopes of the inventive idea, as well as it is clear that in the practical embodiment of the invention the various components described above may be replaced with technically equivalent ones.

The invention claimed is:

1. A system for management and control of a heat pump based on a compression/expansion thermodynamic cycle of an operating fluid, the system comprising:

a first heat exchanger adapted to allow the operating fluid to absorb heat energy from a cold well at a constant pressure;

a second heat exchanger adapted to allow the operating fluid to yield part of the heat energy to a hot well at a constant pressure;

an expansion valve positioned between said first heat exchanger and said second heat exchanger, said expansion valve adapted to carry out constant enthalpy expansion and cooling of the operating fluid;

a compressor adapted to compress the operating fluid between a minimum pressure and a maximum pressure, the minimum pressure being at an outlet of said first heat exchanger, the maximum pressure being at an inlet of said second heat exchanger, said compressor adapted to suck in and compress the operating fluid, said compressor having a lubricating oil therein;

at least one first temperature sensor cooperative with said compressor and adapted to detect a delivery temperature of the operating fluid from said compressor;

at least one second temperature sensor cooperative with said first heat exchanger and adapted to detect an evaporation temperature in said first heat exchanger;

at least one third temperature sensor cooperative with said second heat exchanger and adapted to detect a condensation temperature in said second heat exchanger;

a controller cooperative with said at least one first temperature sensor and with said at least one second temperature sensor and with said at least one third temperature sensor, said controller cooperative with said expansion valve so as to open or close said expansion valve, wherein said controller opens or closes said expansion valve so as to regulate the delivery temperature, wherein said expansion valve opens as long as the delivery temperature of said compressor does not reach a target delivery temperature, the target delivery temperature being based on a wet fraction of the operating fluid entering said compressor and the delivery temperature of the operating fluid of said compressor, wherein the delivery temperature is less than required to evaporate the lubricating oil and more than to condense the operating fluid into the lubricating oil, wherein the opening of said expansion valve corresponds to values at different and consecutive time instants, wherein the values are based on measurements of the delivery temperature by said at least one first temperature sensor and the condensing temperature by said at least one second temperature sensor and the evaporation temperature by said at least one third temperature sensor, wherein the target delivery temperature is determined at an instant following a previous item interval.

2. The system of claim 1, wherein the target delivery temperature is a function of at least one of the evaporation temperature detected by said at least one second temperature sensor and a condensation temperature detected by said at least one third temperature sensor and the safety threshold value of the delivery temperature and a correction coefficient corresponding to heat losses between said compressor and an environment in which the heat pump operates.

3. The system of claim 2, wherein the target delivery temperature is a sum of the condensing temperature and a safety threshold value and a correction factor, the correction factor corresponding to the heat losses.

4. The system of claim 3, wherein the correction factor is equal to a sum of the condensing temperature and the safety threshold value minus the evaporation temperature.

5. A system for management and control of a heat pump based on a compression/expansion thermodynamic cycle of an operating fluid, the system comprising:

a first heat exchanger adapted to allow the operating fluid to absorb heat energy from a cold well at a constant pressure;

a second heat exchanger adapted to allow the operating fluid to yield part of the heat energy to a hot well at a constant pressure;

an expansion valve positioned between said first heat exchanger and said second heat exchanger, said expansion valve adapted to carry out constant enthalpy expansion and cooling of the operating fluid;

a compressor adapted to compress the operating fluid between a minimum pressure and a maximum pressure, the minimum pressure being at an outlet of said first heat exchanger, the maximum pressure being at an inlet of said second heat exchanger, said compressor adapted to suck in and compress the operating fluid, said compressor having a lubricating oil therein;

at least one first temperature sensor cooperative with said compressor and adapted to detect a delivery temperature of the operating fluid from of said compressor;

at least one second temperature sensor cooperative with said first heat exchanger and adapted to detect an evaporation temperature in said first heat exchanger; and at least one third temperature sensor cooperative with said second heat exchanger and adapted to detect a condensation temperature in said second heat exchanger;

a controller cooperative with said at least one first temperature sensor and with said at least one second temperature sensor and with said at least one third temperature sensor, said controller cooperative with said expansion valve so as to open or close said expansion valve, wherein the opening of said expansion valve corresponds to values at different and consecutive time instants, wherein the values are based on measurements of the delivery temperature by said at least one first temperature sensor and the condensing temperature by said at least one second temperature sensor and the evaporation temperature by said at least one third temperature sensor, wherein a target delivery temperature is determined at an instant following a previous time interval, wherein said controller opens or closes said expansion valve relative to a difference between the delivery temperature sensed by said at least one first temperature sensor and the target delivery temperature.

6. The system of claim 5, wherein the heating element is an electric heating element, the electric heating element being activated during the opening of said expansion valve.

7. A system for management and control of a heat pump based on a compression/expansion thermodynamic cycle of an operating fluid, the system comprising:

a first heat exchanger adapted to allow the operating fluid to absorb heat energy from a cold well at a constant pressure;

a second heat exchanger adapted to allow the operating fluid to yield part of the heat energy to a hot well at a constant pressure;

an expansion valve positioned between said first heat exchanger and said second heat exchanger, said expansion valve adapted to carry out constant enthalpy expansion and cooling of the operating fluid;

a compressor adapted to compress the operating fluid between a minimum pressure and a maximum pressure, the minimum pressure being at an outlet of said first heat exchanger, the maximum pressure being at an inlet of said second heat exchanger, said compressor adapted to suck in and compress the operating fluid and a lubricating oil temperature sensor, said compressor having a lubricating oil therein, wherein the lubricating oil temperature sensor is adapted to sense a temperature of the lubricating oil in said compressor;

at least one first temperature sensor cooperative with said compressor and adapted to detect a delivery temperature of the operating fluid of said compressor;

at least one second temperature sensor cooperative with said first heat exchanger and adapted to detect an evaporation temperature in said first heat exchanger;

at least one third temperature sensor cooperative with said second heat exchanger and adapted to detect a condensation temperature in said second heat exchanger; and a controller cooperative with said at least one first temperature sensor and with said at least one second temperature sensor and with said at least one third temperature sensor and with the lubricating oil temperature sensor, said controller cooperative with said expansion valve so as to open or close said expansion valve, wherein said controller opens or closes said expansion valve so as to regulate the delivery temperature of the operating fluid of said compressor, wherein a temperature difference between a temperature of the lubricating oil sensed by the lubricating oil temperature sensor in the compressor and the delivery temperature sensed by the at least one first temperature sensor is equal to or greater than a safety threshold value such that the operating fluid does not condense into the lubricating oil, wherein the operating fluid is a refrigerant, wherein the opening of said expansion valve corresponds to values at different and consecutive time instants, wherein the values are based on measurements of the delivery temperature by said at least one first temperature sensor and the condensing temperature by said at least one second temperature sensor and the evaporation temperature by said at least one third temperature sensor, wherein the target delivery temperature is determined at an instant following a previous item interval.

* * * * *